United States Patent [19]

White

[11] 4,324,057

[45] Apr. 13, 1982

[54] PIN TYPE TOOTH RETENTION SYSTEM

[76] Inventor: Kenneth M. White, 2432 Paliswood Rd. S.W., Calgary, Alberta, Canada, T2V 3P8

[21] Appl. No.: 47,292

[22] Filed: Jun. 11, 1979

[30] Foreign Application Priority Data

Jun. 21, 1978 [CA] Canada ..... 305934

[51] Int. Cl.[3] ..... E02F 9/28

[52] U.S. Cl. ..... 37/142 A; 299/92; 403/224; 403/379; 411/360; 411/512

[58] Field of Search ..... 37/141 R, 141 T, 142 R, 37/142 A; 403/224, 226, 379, 372, 357; 85/8.8; 299/92

[56] References Cited

U.S. PATENT DOCUMENTS

| | | | |
|---|---|---|---|
| 2,005,016 | 6/1935 | Buskirk | 37/142 R |
| 2,366,860 | 1/1945 | Kraft | 403/224 |
| 2,568,075 | 9/1951 | Launder | 37/142 A |
| 2,657,482 | 11/1953 | Launder et al. | 37/142 A |
| 2,798,403 | 7/1957 | Launder | 37/142 A X |
| 3,430,994 | 3/1969 | Keeler | 403/372 |
| 3,520,224 | 7/1970 | Hensley et al. | 37/142 A |
| 3,623,754 | 11/1971 | Moore | 403/224 |
| 3,624,827 | 11/1971 | Liess | 37/142 R |
| 3,801,210 | 4/1974 | Heinold et al. | 37/142 A X |
| 3,864,853 | 2/1975 | Klett et al. | 37/142 R X |
| 3,878,905 | 4/1975 | Schaumann | 299/92 X |
| 3,952,433 | 4/1976 | Heinold et al. | 37/142 A |
| 3,994,608 | 11/1976 | Swiderski et al. | 403/357 X |
| 4,086,713 | 5/1978 | White | 403/226 X |

FOREIGN PATENT DOCUMENTS

| | | | |
|---|---|---|---|
| 1400863 | 12/1968 | Fed. Rep. of Germany | 85/818 |
| 2308296 | 8/1973 | Fed. Rep. of Germany | 37/142 A |

*Primary Examiner*—Steven A. Bratlie

*Attorney, Agent, or Firm*—Dressler, Goldsmith, Shore, Sutker & Milnamow, Ltd.

[57] ABSTRACT

An excavator tooth assembly with an adapter and retaining means comprising an elastomer insert with a longitudinal hole therethrough in which a retaining pin is located to resiliently bias the tooth against an adapter, the assembly being simple and inexpensive.

11 Claims, 7 Drawing Figures

PIN TYPE TOOTH RETENTION SYSTEM

This invention relates to an elastomeric insert for an excavator tooth assembly of the type comprising an adapter having a nose piece designed for a mating fit with a replaceable excavator tooth, the tooth being retained such that accidental disengagement from the adapter is prevented by a retaining pin. The retaining pin in conjunction with the novel separate elastomeric insert forces the excavator tooth onto the adapter such that relative motion between the mating faces on the tooth and adapter is inhibited.

Earth working tools of the type in which the invention is used generally comprise adapter means mounted on an excavating machine bucket or ripper, the adapter means having a generally triangular portion when viewed in longitudinal section, this triangular portion or nose piece being adapted for mating fit with a replaceable tooth or point cap. Means are provided for retaining the tooth on the nose piece such that fairly rapid replacement of the tooth can easily be made with a minimum number of tools.

Prior art retention systems are many and varied relative to their manner of operation and economics of manufacture. These systems include two major groups, those not making provision for forcing the tooth rearwardly on the adapter nose piece by the insertion of the retaining pin, and those in which, by means of the pin or secondary means, the tooth is forced rearwardly onto the adapter.

Dealing with the two major types of systems, Van Buskirk U.S. Pat. No. 2,005,016 deals with a simple bolt and nut system for tooth retention. Systems of this nature suffer from difficulty of tooth replacement since the bolt head or nut generally become worn to the point where it is impossible rapidly to remove the tooth from the adapter. Two other systems of this type are disclosed in U.S. Pat. Nos. 3,624,827 and 3,864,853, wherein essentially round pins are retained by spring means such that accidental removal of the pin is prevented. When the pin holes in the tooth and the adapter are in alignment, relatively rapid insertion and removal of the pin can be made. Generally the pin retention systems of U.S. Pat. Nos. 2,005,016, 3,624,827, 3,864,853 suffer from higher than necessary manufacturing costs since the alignment of the holes in tooth and adapter must be maintained to relatively close tolerances over a production run, and the pin is loaded in shear when the adapter becomes worn through use. Since there has to be some positional tolerance on the holes and no provision for forcing the tooth rearwards onto the adapter, nose piece systems of this type suffer from accelerated wear on the mating surfaces between adapter and tooth.

The second major group of tooth retention systems compensates for some of the problems of the first major group. Typical of all systems of this second major group is provision for forcing the tooth rearwardly on the adapter such that a tight fit between mating surfaces on the tooth and adapter is achieved. Furthermore, there is intentional misalignment of certain surfaces on the tooth and adapter such that the retainer pin, when installed, will cause the preferred tight fit on the mating surfaces.

Dealing with the two methods of achieving the above results U.S. Pat. Nos. 2,568,075 and 2,798,403 cover the expanding pin configurations and Canadian Pat. Nos. 615,011 and 638,908 generally cover the solid pin types having secondary means for forcing the tooth rearward.

Both of these systems for tooth retention are quite effective for supplying the necessary force fit on mating tooth and adapter systems. The split pin system is rather complicated in that the two parts of the pin are generally caused to adhere to the elastomer or rubber in the central section. The solid pin types generally require more elaborate cutouts and reliefs in the nose piece on the adapter such that there is room for the elastomer or rubber insert. The split pin types of system suffer from failure of the bond such that the pin is generally not reusable. Presently available split pin types as per U.S. Pat. No. 2,568,075 require an elliptical hole in the nose piece on the adapter, the provision of which is an expensive manufacturing operation. The solid pin types having separate elastomer means are expensive to manufacture in that elaborate holes and relief areas are required in the nose piece of the adapter. Although in this type of system the pins are reusable they are generally of an intricate shape such that they will interlock with the elastomer means to prevent accidental removal.

It is the object of this invention to overcome in an economical and simple fashion the above disadvantages of known constructions.

According to one aspect of the invention there is provided an insert for use in an excavator tooth assembly, the assembly comprising a replaceable tooth having a cutting end and a mounting end, and being provided with internal surfaces complimentary in shape to mating external surfaces of an adapter and being also provided with two holes that cooperate with a hole through the adapter to receive a retaining pin, the insert being a resilient biasing means having a longitudinal hole therethrough, a first outer surface eccentric relative to the longitudinal hole and compression relief means adjacent the insert whereby the retaining pin is adapted to coact with said longitudinal hole in the insert, the hole in the adapter and the two holes in the tooth mounting end such as to bias the tooth against the mounting end of the adapter and orienting means for locating the insert in the adapter.

A second aspect of the invention is an excavator tooth assembly comprising a replaceable tooth having a cutting end and a mounting end, an adapter and a substantially cylindrical retaining pin, the tooth mounting end being provided with internal surfaces complimentary in shape to mating external surfaces of said adapter, the tooth mounting end also being provided with two holes to act in conjunction with a hole through the adapter all of which receive the retaining pin, an insert having a longitudinal hole therethrough, a first outer surface eccentric relative to said longitudinal hole, a second outer surface eccentric relative to said first outer surface and said longitudinal hole and compression relief means adjacent the insert whereby the retaining pin is adapted to coact with said longitudinal hole in the insert, the hole in the adapter and the two holes in the tooth mounting end such as to bias the tooth against the mounting end of the adapter and the second outer surface orients the insert in the hole through the adapter.

For the purpose of illustration, but not of limitation, an embodiment of the invention will be hereinafter described with reference to the drawings, in which.

Figure 1:
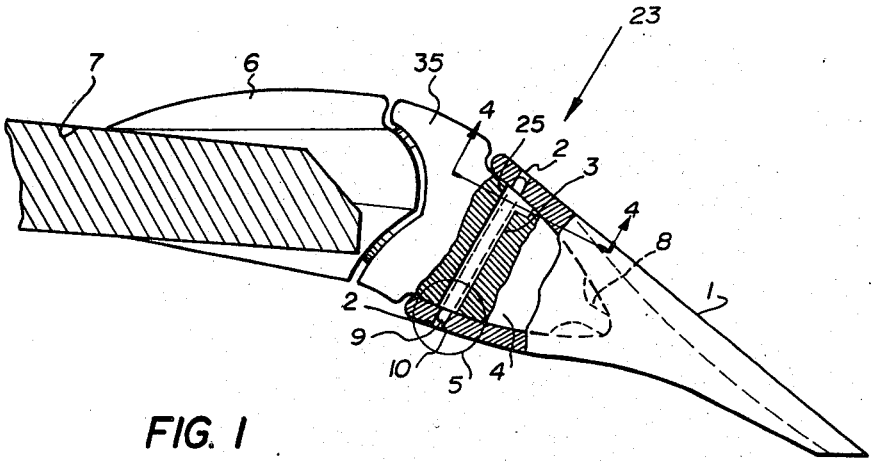
FIG. 1 is a side view partially in section of the basic tooth and adapter system with the pin oriented vertically.

Referring to FIG. 1, an excavator tooth 1 having a round retaining pin hole 2 is retained by force transmission through elastomer insert means 3 to the nose piece 4 of adapter 35. Adapter 35 fits into socket 6 in a semireplaceable manner such that when adapter 35 wears the more expensive assembly of socket 6 and bucket 7 does not have to be changed. Flat surface means 8 on the forward portion of the nose piece 4 prevent accidental loading in shear of the retaining pin 9 under certain excavating conditions. In working conditions, when a tooth is to be replaced, a simple round punch is used to drive the retaining pin 9 through the bottom hole 10. The tooth is removed and a new tooth is installed simply by driving a retaining pin 9 into the hole 2 and insert 3 which is a resilient biasing means. The insert 3 is not replaced each time a tooth is changed, nor is pin 9. Since pin 9 does not have to be orientated in any specific manner for insertion there is very little operator dependence and thus little chance of improper tooth installation.

Figure 2:
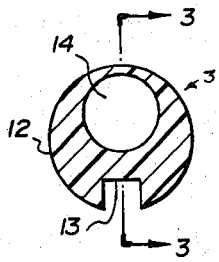
FIG. 2 is a cross sectional elevation of the insert along the line 2—2 of FIG. 3.

The insert 3 is shown in cross section in FIG. 2. The outside diameter 12 of the insert is slightly larger than the diameter of the hole 25 through the nose piece 4 on adapter 35 such that the insert is a light drive-in fit into hole 25. Compression relief 13 is provided in the insert, such that the material displaced when the pin 9 is driven into hole 14 in the insert 3, partially fills compression relief 13. In the described embodiment, this relief 13 is in the form of a longitudinal slot. Hole 14 is sized during manufacture such that it is smaller in diameter than pin 9 thereby causing a tensile stress in a portion of the insert when the pin is installed.

Figure 3:
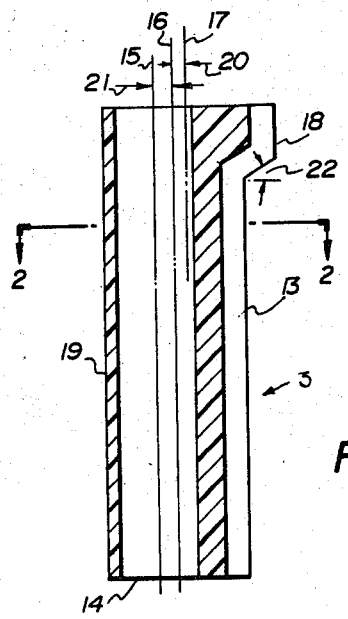
FIG. 3 is a longitudinal sectional elevation of the insert of the retainer system along line 3—3 of FIG. 2.

FIG. 3 indicates the relative centerlines of the various surface radii and hole 14 for pin 9. Centerline 17 is the centerline of the upper part 18 of the insert 3 and is offset from the centerline 16 of the lower part 19, by distance 20. This eccentricity is provided such that the insert 3 cannot be installed in the hole 25 of the nose piece 4 in an incorrect orientation. Upper part 18 fits into area 26 (FIG. 4) in nose piece 4. This eccentricity also prevents accidental rotation of the insert 3 in the nose piece hole during working operation of the tooth, adapter and pin assembly. The distance 21 represents the eccentricity of the lower part 19 with the hole 14. It should be noted that upper part 18 blends into lower part 19 at an angle 22. It is preferred that this angle be approximately 31 degrees such that standard drills can be used for the hole 25,26 in the nose piece 4. The compression relief 13 is shown to traverse the overall length of the elastomeric insert 3 substantially as indicated by FIG. 3.

Figure 4:
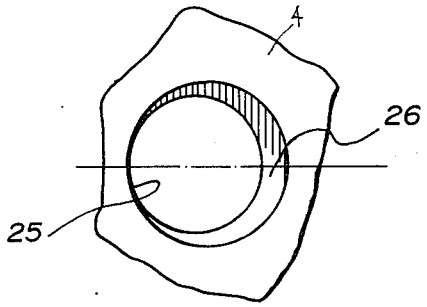
FIG. 4 is a sectional elevation along line 4—4 of FIG. 1 showing the bore in the nose piece on the adapter if the tooth and insert were removed.

The view shown in FIG. 4 would represent hole 25 through the nose piece 4, hole 25 being slightly smaller in diameter than the lower part 19 of the insert shown in FIG. 3 such that the preferred light drive fit is generated. The upper part 18 of the insert shown in FIG. 3 fits into relief area 26 such that the relative eccentricity of hole 25 and relief area 26 is substantially equal to distance 20 as indicated in FIG. 3.

Figure 5:
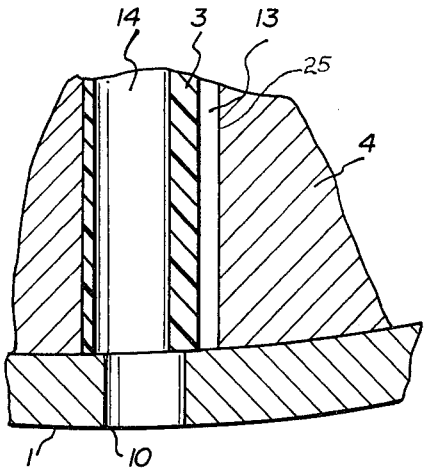
FIG. 5 is an expanded view of encircled area 5 in FIG. 1.
Figure 6:
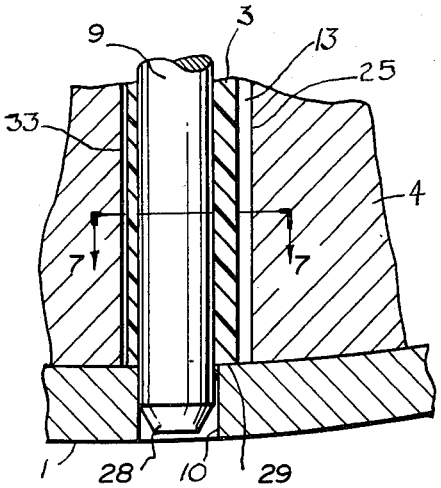
FIG. 6 is an expanded view like FIG. 5 with the retainer pin installed.

The assembly shown in FIG. 5 indicates encircled area 5 of FIG. 1 if the pin 9 were removed. The hole 10 in tooth 1 is not in alignment with the hole 14 in insert 3 such that when pin 9 as shown in FIG. 6 is installed a force due to a combination of tension and compression is generated in insert 3 tending to push the tooth rearward on nose piece 4. The hole 10 is larger in diameter than pin 9 such that pin 9 enters freely. Pin 9 preferably has both ends bevelled as shown at 28 in FIG. 6 such that it is reversible in operation. It is further preferred that pin 9 be surface hardened approximately 10 Rockwell C $R_c$ harder than the tooth 1 such that the sharp edge generated at the inner surface 29 of tooth 1 due to punching of the pin hole 10 does not damage the end of the pin 9 during insertion.

Figure 7:
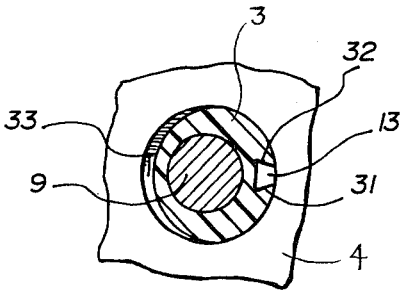
FIG. 7 illustrates the compression characteristics of the insert when the pin is installed as would be viewed in section along line 7—7 of FIG. 6.

FIG. 7 illustrates the lower portion section along a line 7—7 of FIG. 6. Herein compression relief 13 is reduced in area from the equivalent area shown in FIG. 2. It is noted that the compression relief 13 has been bent inwards as indicated by the non-parallel surfaces 31 and 32. It is particularly important that the insert 3 be manufactured of a material of a hardness level such that bending forces are generated along the compression relief 13. A suitable hardness range for the insert has been found to be from 60 A to 95 A durometer hardness as measured on the Shore hardness scale. As shown in FIG. 7, due to the forces generated the pin 9 has been moved ahead such that a void space 33 is formed over a rearward portion of the hole 25. The void space 33 will vary in size due to manufacturing tolerances on the adapter and tooth such that when the maximum offset tolerance of the positions of the holes is reached the compression relief 13 is completely filled with the displaced insert. When the minimum offset tolerance is reached the pin holes 2 and 10 in the tooth FIG. 1 are substantially in alignment with the pin hole 14 (FIG. 2) in the insert. In this condition there is no force generated causing a tight mating surface fit between the adapter and tooth. There is however a tensile force in the insert due to the retaining pin being of a larger diameter than the hole in the insert; this force is necessary to prevent accidental removal of the pin.

The retention system can be seen to offer several advantages over presently available systems. First, a reversible case hardened pin as would be produced from cold rolled round stock is combined with an insert in such a manner that a combination of tension and compression is generated in the insert. The combination of forces generated is such that a wide range of manufacturing tolerances and field wear can be compensated for. The simplicity of using drilled holes in a forged adapter or plain round cored holes in a casting is economical from a manufacturing point of view both for the teeth and adapters using this system.

The embodiments of the invention in which an exclusive property or privilege is claimed are defined as follows:

1. An excavator tooth assembly comprising a replaceable tooth having a cutting end and a hollow mounting end, and an adapter having a nose piece which is triangular in longitudinal cross-section mated with the mounting end of said tooth, the mounting end of said tooth being provided with two opposed holes to act in conjunction with a hole extending through the adapter, a resilient insert having a longitudinal hole therethrough to define a first outer surface eccentric to said longitudinal hole, said eccentric outer surface providing a thicker portion which includes compression relief means, orienting means positioning said insert in said hole in said adapter with said thicker portion extending toward the cutting end of the tooth, said orienting means comprising a second outer surface eccentric relative to said first outer surface and said longitudinal hole to provide a protuberance which is fitted into an opening in said nose piece, and a retaining pin extending across the triangle of said nose piece, through said longitudinal hole in said insert, and into the two opposed holes in the mounting end of said tooth to bias said tooth rearwardly along said nose piece.

2. An excavator tooth assembly according to claim 1 wherein said compression relief means comprises a single longitudinal slot in said first and second outer surfaces at substantially the point of maximum eccentricity relative to said longitudinal hole.

3. An excavator tooth assembly according to claim 2 wherein said longitudinal hole in said insert is of smaller diameter than said retaining pin to produce a tensile force on said insert, and said longitudinal hole and said two opposed holes in the mounting end of said tooth are out of alignment prior to the insertion of the retaining pin so that said retaining pin biases said tooth rearwardly along said nose piece.

4. An excavator tooth assembly according to claim 2 in which said insert as mounted in said adapter hole has said longitudinal slot facing in a direction towards the cutting end of said replaceable tooth.

5. An excavator tooth assembly according to claim 2 wherein said first and said second outer surface of said insert are of circular shape when viewed in lateral section, with said longitudinal slot having a depth substantially equal to its width.

6. An excavator tooth assembly according to any one of claims 1, 2 and 5 wherein said insert has a hardness as measured by the Shore hardness test of approximately 60 A to 95 A.

7. An excavator tooth assembly according to claim 1 wherein said retaining pin is substantially cylindrical and has bevelled ends to facilitate entry into the longitudinal hole of said insert, said retaining pin further having a surface hardness approximately 10 Rockwell $C(R_c)$ harder than the excavator tooth which it engages.

8. A resilient insert for use in an excavator tooth assembly comprising an elongated resilient member having a Shore hardness of approximately 60 A to 95 A, said resilient member having a circular outer surface and a longitudinal hole extending through the member from one end to the other and adapted to receive a retaining pin, said hole being eccentrically positioned with respect to said circular outer surface so that said resilient member is thicker on one side of the hole, one end of said resilient member being enlarged with said enlarged end having a circular outer surface eccentric relative to said circular outer surface of said insert and said hole so that the enlarged end is eccentrically positioned with respect to the axis of said hole, and a longitudinal slot in the outer surface of the thicker portion of said resilient member to enable compression relief.

9. An insert as defined in claim 8 wherein said longitudinal slot is positioned at substantially the point of maximum eccentricity relative to said longitudinal hole.

10. An insert as defined in claim 9 wherein said longitudinal slot has a depth substantially equal to its width.

11. An insert as defined in claim 8 wherein said longitudinal hole in said insert is of a diameter smaller than the diameter of the retaining pin which is to be received within it.

* * * * *